United States Patent [19]

Shikano et al.

[11] Patent Number: 4,910,484

[45] Date of Patent: Mar. 20, 1990

[54] ELECTROMAGNETIC RELAY HAVING SILENCING EFFECT

[75] Inventors: Yukio Shikano; Shigemitsu Aoki, both of Saku, Japan

[73] Assignee: Takamisawa Electric Co., Ltd., Tokyo, Japan

[21] Appl. No.: 342,618

[22] Filed: Apr. 24, 1989

Related U.S. Application Data

[63] Continuation of Ser. No. 162,547, Mar. 1, 1988, abandoned.

[30] Foreign Application Priority Data

Mar. 6, 1987 [JP] Japan ..... 62-31868
Nov. 19, 1987 [JP] Japan ..... 62-175792

[51] Int. Cl.[4] ..... H01H 7/03; H01H 43/02

[52] U.S. Cl. ..... 335/61; 335/59; 335/240

[58] Field of Search ..... 335/61, 62, 59, 63, 335/90, 104, 105, 157, 158, 193, 240; 248, 128, 135, 220; 200/88

[56] References Cited

U.S. PATENT DOCUMENTS

| | | | |
|---|---|---|---|
| 1,779,328 | 10/1930 | O'Brien | 335/200 |
| 1,981,259 | 11/1934 | Wertz | 335/200 |
| 3,242,285 | 3/1966 | Obszarny | 335/135 |
| 3,389,354 | 6/1968 | Ahlberg | 335/248 |

FOREIGN PATENT DOCUMENTS

| | | | |
|---|---|---|---|
| 61-75042 | 5/1986 | Japan . | |
| 240307 | 12/1945 | Switzerland | 337/61 |

*Primary Examiner*—H. Broome
*Attorney, Agent, or Firm*—Armstrong, Nikaido, Marmelstein, Kubovcik & Murray

[57] ABSTRACT

A relay comprises a yoke, an armature, a movable contact spring having a movable contact, at least one stationary contact mounted thereon, and a core. An air damper is mounted on a free end of the movable spring, or on a free end of the armature, to reduce sound generated by the impulsive force of the movable contact and the impulsive force of the armature.

14 Claims, 4 Drawing Sheets

ELECTROMAGNETIC RELAY HAVING SILENCING EFFECT

This application is a continuation of application Ser. No. 162,547 filed Mar. 1, 1988, (now abandoned).

BACKGROUND OF THE INVENTION

1. Field of the Invention

The present invention relates to an electromagnetic relay having a remarkable silencing effect during an activating mode and a releasing mode. Such a relay is used particularly in an automobile, an air conditioner, and the like.

2. Description of the Related Art

An electromagnetic relay is conventionally comprised of a yoke, an armature rotatably coupled with an end of the yoke, a movable contact spring associated with the armature, and a core having a bottom fixed to another end of the yoke and a top opposing the armature. Also, at least one movable contact is mounted on the movable contact spring, and a corresponding stationary contact is provided. When a winding wound on the core is excited to activate the relay, the armature is attracted by the core and a sound is generated due to the impulsive force of the movable contact against the stationary contact when making contact therewith and the impulsive force of the armature against the top of the core. In the prior art, to reduce this sound, a helix spring is provided on the top of the core (see: Unexamined Japanese Utility Model Publication No. 61-75042), which will be later explained in detail.

In the above-mentioned prior art, however, since the load of the helix spring is added to the entire load of the relay, the relay load is increased, and therefore, when the attraction force of the core is definite, the margin of operation is reduced, and further, the contact force of the movable contact against the stationary contact, which in this case is a make contact, is reduced, thus reducing the performance of the operation. Further, the helix spring is not intended to reduce a sound due to the impulsive force of the movable contact against the stationary contact, which in this case is a break contact, when the winding is non-excited to release the relay.

SUMMARY OF THE INVENTION

Therefore, an object of the present invention is to reduce a sound generated by the impulsive force of the movable contact against stationary contacts including a make contact and a break contact, and the impulsive force of the armature against the top of the core during an activating mode and a releasing mode, without reducing the margin and performance of the operation.

According to the present invention, an air damper is mounted on a free end of the movable spring, or on a free end of the armature to reduce a sound generated by the impulsive force of the movable contact and by the impulsive force of the armature. Also, a magnetic plate is interposed between the armature and the top of the core to reduce a sound generated by the impulsive force of the armature.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

First, a prior art electromagnetic relay will be explained with reference to FIGS. 1A and 1B (see: Unexamined Japanese Utility Model Publication No. 61-75042).

Figure 1A:
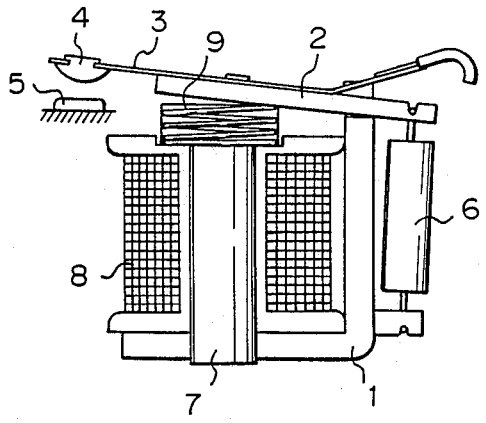
Fig. 1A PRIOR ART
FIG. 1A is a partly cut-away side view showing a non-activated state of a prior art electromagnetic relay.

In FIG. 1A, reference numeral 1 designates a yoke, 2 an armature rotatably coupled with an end of the yoke 1, and 3 a movable contact spring associated with the armature 2. The movable contact spring 3 has a movable contact 4 thereon opposing a stationary contact 5, which in this case is a make contact. Reference numeral 6 designates a return spring for pulling up the armature 2 when the relay is not activated. A core 7, on which a winding 8 is wound, has a bottom fixed to the yoke 1 and a top opposing the armature 2.

In FIG. 1A, a helix spring 9 is provided on the top of the core 7 to reduce a sound generated by the impulsive force of the armature 3 against the top of the core 7 and the impulsive force of the movable contact spring 3 (or the movable contact 4) against the stationary contact 5.

Figure 1B:
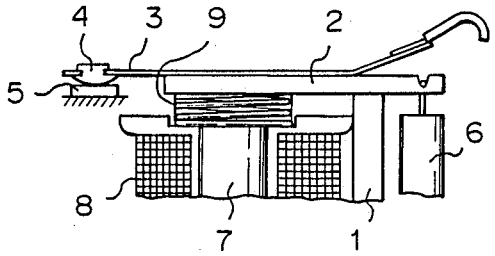
Fig. 1B PRIOR ART
FIG. 1B is a partly cut-away side view showing an activated state of the relay of FIG. 1A.

As shown in FIG. 1B, when the winding 8 is excited to activate the relay, the load of the helix spring 9 is added to the load of the relay, thus increasing the relay load. Therefore, when the attractive force of the excited core 7 is definite, the margin of operation is reduced, and further, the contact force between the movable contact 4 and the stationary contact 5 is reduced, thus reducing the performance of the operation of the relay.

In FIGS. 2A, 2B, 2C, and 2D, while illustrate a first embodiment of the present invention, reference numeral 11 designates an L-shaped yoke, 12 an armature rotatably coupled with an end of the yoke, 13 a movable contact spring associated with the armature 12, and 14 a movable contact mounted on the movable contact spring 13. The movable contact 14 opposes stationary contacts, i.e., a make contact **15*a* and a break contact 15*b*. Reference numeral 16 designates a return spring for pulling up the armature 12 when the relay is not activated. Note that the return spring 16 is integral with the movable contact spring 13. A core 17 has a bottom fixed to the yoke 11 and a top opposing the armature 12. A winding 18 is wound on the core 17 via a bobbin 18*a***.

Also, reference numeral 19 designates a substrate for supporting external lead pins and an air damper 20. The air damper 20 is comprised of a piston 21, a cylinder 22, and a coupling member 23 which couples the piston 21 with a free end of the movable contact spring 13. A speed of motion of the movable contact spring 13 is reduced by the viscosity resistance of air flowing through a gap between the piston 21 and the cylinder 22, thus reducing the impulsive force between the movable contact spring 13 (the movable contact 14) and the stationary contacts **15*a* and 15*b*, and the impulsive force between the armature 12 and the top of the core 17**, thereby exhibiting an excellent silencing effect.

Note that the cylinder 22 of the air damper 20 can be formed simultaneously with the molding of the substrate 19, thus reducing the number of components of the relay. Also, it is possible to provide the air damper in a space of the prior art relay, and accordingly, the size of the relay is reduced.

The operation of the relay of FIGS. 2A, 2B, 2C, and 2D will be explained below. When the winding 18 is excited by supplying a current thereto, the armature 12 is attracted to the top of the core 17, so that the free end of the movable contact spring 13 associated with the armature 12 pushes down the piston 21 via the coupling member 23. In this case, since the piston 21 is enveloped by the cylinder 22, the speed at which the piston 21 is pushed down is determined by the viscosity resistance of air flowing from the cylinder 22 to the exterior, and is reduced when compared with the case where the air damper 20 is not provided.

Then, when the piston 21 exceeds a contact gap distance, the movable contact 14 comes into contact with the stationary contact 15*a* and the armature 12 is attracted to the top of the core 17 at a weak abutment force. In this state, there is no load from the air damper 20, and therefore, the load of the relay is not increased.

Figure 2A:
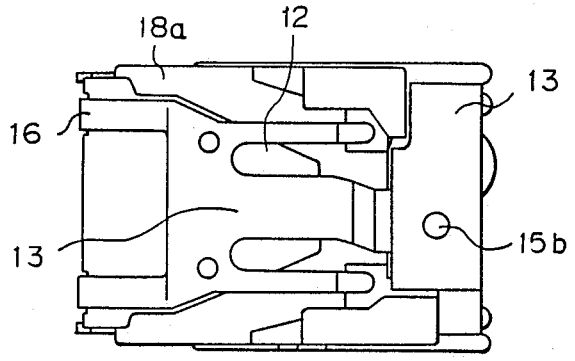
FIG. 2A is a plan view illustrating a first embodiment of the electromagnetic relay according to the present invention.
Figure 2B:
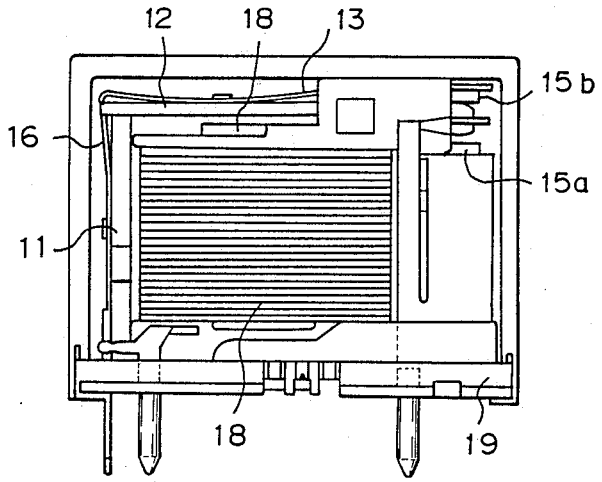
FIG. 2B is a side view of the relay of FIG. 2A.
Figure 2C:
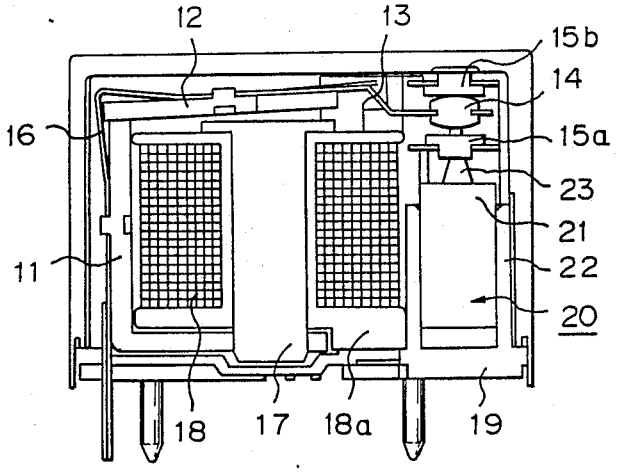
FIG. 2C is a partly cut-away side view of the relay of FIG. 2A.
Figure 2D:
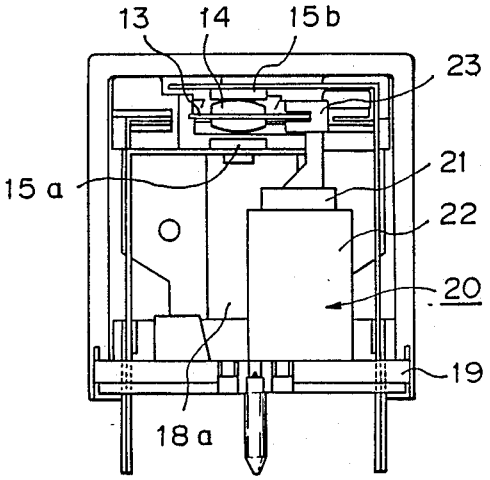
FIG. 2D is a front view of the relay of FIG. 2A.

Subsequently, when the excitation of the winding 18 is released, the armature 12 is rotated by the return spring 16 in the direction opposite to the previous direction (i.e., in the counterclockwise direction in FIGS. 2B and 2C). In this case, since the piston 21 is coupled by coupling members 23, FIG. 2D, with the free end of the movable contact spring 13 mounted on the armature 12, the piston 21 is pulled up by springs 13, 16, at a speed determined by the viscosity resistance of air flowing into the exterior to the cylinder 22, so that the movable contact 14 abuts the stationary contact 15*b* at a weak abutment force.

Note that the air damper 20 can be provided integrally with the movable contact spring 13 or at a free end of the armature 12.

Generally, in an electromagnetic relay used in an automobile or an air-conditioner, a level of sound pressure due to the activation and release of the relay is usually about 75 dB, however, in the relay of FIGS. 2A, 2B, 2C, and 2D, an experimental value was less than 60 dB.

Figure 3:
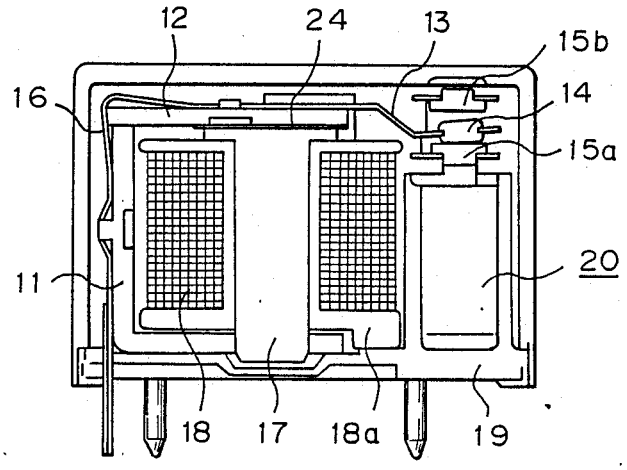
FIG. 3 is a partly cut-away side view illustrating a second embodiment of the electromagnetic relay according to the present invention.

In FIG. 3, which illustrates a second embodiment of the present invention, a magnetic plate 24 is added to the elements of the first embodiment of FIGS. 2A, 2B, 2C, and 2D. In FIG. 3, when a current is supplied to the winding 18 to attract the armature 12 to the core 17, vibrations due to the impulsion of the armature 12 to the top of the core 17 are transmitted to the magnetic plate 24, and therefore, the vibrations are absorbed by the magnetic plate 24. As a result, such vibrations are not substantially transmitted to the armature 12 and the core 17.

Thus, since the magnetic plate 24 is provided at the attraction face of the armature 12 opposing the top of the core 17, so that the armature 12 does not abut against the top of the core 17 directly, thereby eliminating the impulsive sound by the magnetic plate 24 when the armature 12 abuts against the core 17. This exhibits also an excellent silencing effect. Particularly, when the magnetic plate 24 is made of an anti-vibration material such as Fe-Co-V alloy, the silencing effect is remarkably increased.

Note that the magnetic plate 24 can be provided on the top of the core 17, thus exhibiting the same effect.

Also, the silencing effect can be expected in the second embodiment without the air damper 20. In this case, in an automobile or an air-conditioner, an experimental level of sound pressure due to the activation and release of the relay was also less than 60 dB.

As explained hereinbefore, according to the present invention, use is made of the viscosity resistance of air in the air damper, so that a load in proportion to the activation speed and release speed of the movable contact spring can be obtained. This load is not a load of the relay in a static operation where the operation of the relay is very slow. Also, since the relay can be operated without changing the spring load of the relay, this is a very effective measure for silencing impulsive sound when the relay is released.

We claim:

1. An electromagnetic relay comprising:

a yoke;

an armature rotatably coupled with an end of said yoke;

a movable contact spring fixed to said armature, said movable contact spring having at least one movable contact mounted thereon;

at least one stationary contact opposing said movable contact;

a core having a bottom fixed to another end of said yoke and a top opposing said armature; and an air damper mounted directly on a free end of said movable contact spring for reducing the speed of motion of said movable contact spring.

2. A relay as set forth in claim 1, wherein said air damper comprises:

a piston;

a cylinder for enveloping said piston;

a coupling member coupled between said piston and a free end of said movable contact spring.

3. A relay as set forth in claim 2, further comprising a substrate for supporting external lead pins, said substrate being made integral with said cylinder by a molding process.

4. An electromagnetic relay comprising:

a yoke;

an armature rotatably coupled with an end of said yoke;

a movable contact spring fixed to said armature, said movable contact spring having at least one movable contact mounted thereon;

at least one stationary contact opposing said movable contact;

a core having a bottom fixed to another end of said yoke and a top opposing said armature;

an air damper mounted directly on a free end of said movable contact spring for reducing the speed of motion of said movable contact spring; and, a magnetic plate mounted on a face of said armature opposing the top of said core.

5. A relay as set forth in claim 4, wherein said magnetic plate is made of a material having vibration damping characteristics.

6. A relay as set forth in claim 5, wherein said material is Fe-Co-V alloy.

7. An electromagnetic relay comprising:

a yoke;

an armature rotatably coupled with an end of said yoke;

a movable contact spring fixed to said armature, said movable contact spring having at least one movable contact mounted thereon;

at least one stationary contact opposing said movable contact;

a core having a bottom fixed to another end of said yoke and a top opposing said armature;

an air damper mounted directly on a free end of said movable contact spring for reducing the speed of motion of said movable contact spring; and, a magnetic plate mounted on the top of said core.

8. A relay as set forth in claim 7, wherein said magnetic plate is made of a material having vibration damping characteristics.

9. A relay as set forth in claim 8, wherein said material is Fe-Co-V alloy.

10. An electromagnetic relay comprising:

a yoke;

an armature rotatably coupled with an end of said yoke;

a movable contact spring fixed to said armature, said movable contact spring having at least one movable contact mounted thereon;

at least one stationary contact opposing said movable contact;

a core having a bottom fixed to another end of said yoke and a top opposing said armature;

a magnetic plate interposed between said armature and the top of said core; and an air damper mounted directly on a free end of said movable contact spring for reducing the speed of motion of said movable contact spring.

11. A relay as set forth in claim 10, wherein said magnetic plate is mounted on a face of said armature opposing the top of said core.

12. A relay as set forth in claim 10, whereinsaid magnetic plate is mounted on the top of said core.

13. A relay as set forth in claim 10, wherein said magnetic plate is made of a material having vibration damping characteristics.

14. A relay as set forth in claim 13, wherein said material is Fe-Co-V alloy.

* * * * *